United States Patent [19]

Shivar

[11] 4,421,680

[45] Dec. 20, 1983

[54] CLEANING AND DEGREASING COMPOSITION

[76] Inventor: Irving Shivar, Rte. 2, Box 231, Camden, S.C. 29020

[21] Appl. No.: 303,467

[22] Filed: Sep. 18, 1981

[51] Int. Cl.[3] ..... C11D 1/84; C11D 3/08

[52] U.S. Cl. ..... 252/526; 252/153; 252/171; 252/527; 252/528; 252/529; 252/539; 252/DIG. 14

[58] Field of Search ..... 252/153, 158, 526, 527, 252/528, 529, 539, 171, DIG. 14, DIG. 7

[56] References Cited

R U.S. PATENT DOCUMENTS

| | | | |
|---|---|---|---|
| 3,882,038 | 5/1975 | Clayton et al. | 252/164 |
| 3,910,855 | 10/1975 | Abeles | 252/527 |
| 3,960,742 | 6/1976 | Leonard | 252/90 |
| 4,087,387 | 5/1978 | Willems et al. | 252/524 |
| 4,158,644 | 6/1979 | Hammerel | 252/547 |

FOREIGN PATENT DOCUMENTS 1300699 6/1962 France .

OTHER PUBLICATIONS

"A Formulary of Detergents and Other Cleaning Agents," Chemical Publishing Co., N.Y., 1980, pp. 286, 287, 289, 290.

*Primary Examiner*—P. E. Willis, Jr.
*Attorney, Agent, or Firm*—Dority & Flint

[57] ABSTRACT

A degreasing composition consisting essentially of 3–5% by weight of an ethylene glycol monoalkyl ether; 3–5% by weight of $RCON(C_nH_{2n}OH)_2$), wherein R is alkly of 8–18 carbon atoms and n is 2 or 3; 0.5–1.5% by weight of sodium metasilicate pentahydrate; 0.1–9.5% by weight of KOH; 1–3% by weight of $R'CONH(CH_2)_3N^+(CH_3)_2CH_2COO^-$, wherein R′ is alkyl of 8–18 carbon atoms; 3–5% by weight of $R''-C_6H_4-SO_3^-H_3N^+R'''$, wherein R″ is alkyl of 9–15 carbon atoms and R‴ is alkyl of 2–4 carbon atoms; and water.

1 Claim, No Drawings

CLEANING AND DEGREASING COMPOSITION

BACKGROUND OF THE INVENTION

1. Field of Invention

This invention relates to a water-based cleaning and degreasing composition for automotive parts or other objects contaminated with oil, diesel fuel or grease.

2. Prior Art

Leonard has proposed, in U.S. Pat. No. 3,960,742, a water-dispersible emulsion type cleaner for industrial and household maintenance comprising a concentrate of an ethylene glycol lower alkyl ether, an alkali hydroxide, a metasilicate, a nonionic ampholyte and an alkali salt of a lower alkylbenzene sulfonate.

Ulvild has proposed, in U.S. Pat. No. 3,887,497, a degreasing product containing an alkylbenzenesulfonic acid detergent surfactant, a liquid organic solvent, an alkaline builder and water.

Mausner et al. have proposed, in U.S. Pat. No. 3,709,838, a liquid detergent composition containing an ethanolamine salt of an alkylarylsulfonic acid, an alkoxylated ether of a monohydric alcohol or alkylphenol and a fatty acid alkanolamide. The compositions can be diluted with water at the time of use, but are unstable unless prepared under essentially anhydrous conditions. Mausner et al. have also proposed, in U.S. Pat. No. 3,232,880, a similar product containing a phosphate builder and one or more cellulose derivatives.

Wixon has proposed, in U.S. Pat. No. 3,272,753, a detergent composition containing a mixture of arylsulfonate salts, sodium silicate, a fatty acid alkanolamide, ethanol and water.

Other detergent compositions are disclosed by Trowbridge II (U.S. Pat. No. 2,704,280), Ruff et al. (U.S. Pat. No. 2,829,108), Sato et al. (U.S. Pat. No. 3,822,312) and Flanagan (U.S. Pat. No. 4,203,872).

The foregoing references indicate that compositions useful as medium and heavy duty degreasers contain relatively large amounts of organic solvents, detergent and builder in the aqueous medium employed.

There is therefore a need for medium and heavy duty degreasing compositions which have lower concentrations of organic solvent, detergent and builders than heretofore and which are accordingly inflammable and relatively safe to use.

OBJECT OF THE INVENTION

It is the object of this invention to provide a cleaning composition, for medium- and heavy-duty degreasing utility, which contains lower levels of organic solvent, detergent and builder than heretofore and which is safer to use than compositions previously available for this purpose.

SUMMARY OF THE INVENTION

This invention relates to a degreasing composition consisting essentially of 3–5% by weight of an ethylene glycol monoalkyl ether; 3–5% by weight of $RCON(C_nH_{2n}OH)_2$, wherein R is alkyl of 8–18 carbon atoms and n is 2 or 3; 0.5–1.5% by weight of sodium metasilicate pentahydrate; 0.1–0.5% by weight of KOH; 1–3% by weight of $R'CONH(CH_2)_3N^+(CH_3)_2CH_2COO^-$, wherein R′ is alkyl of 8–18 carbon atoms; 3–5% by weight of $R''$-$C_6H_4$-$SO_3^-H_3N^+R'''$, wherein R″ is alkyl of 9–15 carbon atoms and R‴ is alkyl of 2–4 carbon atoms; and water.

DETAILED DESCRIPTION

"Ethylene glycol monoalkyl ether," as used in the specification and claims, is a compound of the formula $HOCH_2CH_2OC_{n'}H_{2n'+1}$, in which n is an integer from 1–20. Preferred ethers are those wherein n′ is 1–6, that is, the methyl, ethyl, propyl, butyl, pentyl and hexyl ethers, including the various isomers. Most preferred is ethylene glycol monobutyl ether, also known as butyl Cellosolve.

The amount of ethylene glycol monoalkyl ether is from 3–5% by weight, preferably 3.5–4.5% by weight. Most preferably, the compositions will contain 4.0–4.25% by weight of the ethylene glycol monoalkyl ether.

The ingredient represented by the formula $RCON(C_nH_{2n}OH)_2$ can also be called a fatty acid dialkanolamide. When R is of 9–17 carbon atoms, the corresponding fatty acid is of 10–18 carbon atoms, including decanoic (capric), lauric, myristic, palmitic and stearic acids. Mixtures are also useable. It is preferred to use a coconut acid dialkanolamide, the coconut acid being a mixture of lauric, myristic, stearic and palmitic acids.

The dialkanolamide is obtained by reaction between the fatty acid and a dialkanolamine, more particularly, diethanolamine or diisopropanolamine. Amides derived from diethanolamine are preferred.

The amount of fatty acid dialkanolamide used in the compositions of this invention is from 3–5% by weight, preferably 3.5–4.5% by weight, most preferably 4.0–4.25% by weight.

The amount of sodium metasilicate pentahydrate used in the compositions of this invention is 0.5–1.5% by weight, preferably 0.75–1.0% by weight.

Potassium hydroxide can be used in the form of the solid or an aqueous solution in preparing the compositions of this invention. The amounts indicated in the specification and claims will, unless otherwise indicated, refer to solid KOH. The amount of KOH used in the compositions of this invention is 0.1–0.5% by weight, preferably 0.2–0.4% by weight, most preferably 0.2–0.3% by weight.

The ingredient represented by the formula $R'CONH(CH_2)_3N^+(CH_3)_2CH_2COO^-$ is also known as a betaine and is derived from the same kinds of fatty acids as the alkanolamides used in the practice of this invention. Cocamidopropyl betaine is preferred.

Contemplated equivalents of the foregoing betaines include the range of 271 to 412 grams.

The amount of betaine used in the compositions of this invention is 1–3% by weight, preferably 1.5–2.5% by weight, most preferably 1.75–2.0% by weight.

The ingredient represented by the formula $R''$-$C_6H_4$-$SO_3^-$-$H_3N^+R'''$ is a detergent amine salt of an alkylbenzenesulfonic acid. The alkyl represented by R″ can be straight or branched chain. However, detergent alkylates are frequently made with propylene or butylene oligomers and will have branched structures. Oligomers obtained from ethylene will have an unbranched structure. It is preferred that R″ in $R''$-$C_6H_4SO_3H$ is of 12 carbon atoms, whether as a pure compound or as a mixture having an average of 12 carbon atoms.

Ethyl, propyl, isopropyl or any of the butyl amines can be used to form the amine salt used as detergent. The isopropylamine salt is preferred.

The amount of detergent amine salt of alkylbenzenesulfonic acid used in the compositions of this invention is from 3–5% by weight, preferably 3.5–4.5% by weight, most preferably 4.0–4.25% by weight.

The compositions of this invention are made by adding the solutes to water, in any order, and stirring until a homogeneous product is obtained. It is preferred to use KOH in the form of a concentrated aqueous solution.

The compositions of this invention contain relatively small amounts of solute, when compared to known medium- and heavy-duty degreasers, and preferably contain at least 82% by weight of water.

The degreasing compositions are particularly useful for cleaning metal surfaces soiled with oil, diesel fuel or other petroleum-derived products. The compositions will therefore be used on automobile engines and in engine compartments and for cleaning heavy equipment or machinery. The compositions can be applied with a cloth or brush.

The product is safe to use, is effective for cleaning greasy surfaces, is odorless and presents no fire hazard.

DESCRIPTION OF MOST PREFERRED EMBODIMENT

A most preferred composition is accordance with this invention will be one consisting essentially of 4.0–4.25% by weight of ethylene glycol monoalkyl ether, 4.0–4.25% by weight of $RCON(C_nH_{2n}OH)_2$, 0.75–1.0% by weight of sodium metasilicate pentahydrate, 0.2–0.3% by weight of potassium hydroxide, 1.75–2.0% by weight of $R'CONH(CH_2)_3N^+(CH_3)_2CH_2COO^-$, 4.0%–4.25% by weight of $R''\text{-}C_6H_4\text{-}SO_3^-H_3N^+R'''$ and water, wherein the ethylene glycol monoalkyl ether is n-butoxyethanol, $RCON(C_nH_{2n}OH)_2$ is a coconut diethanolamide, $R'CONH(CH_2)_3N^+(CH_3)_2CH_2COO^-$ is cocamidopropyl betaine and $R''\text{-}C_6H_4\text{-}SO_3^-H_3N^+R'''$ is an isopropylamine salt of dodecylbenzenesulfonic acid.

Without further elaboration, it is believed that one skilled in the art can, using the preceding description, utilize the present invention to its fullest extent.

The following preferred specific embodiments are, therefore, to be construed as merely illustrative and not limitative of the remainder of the disclosure in any way whatsoever. In the following Examples, unless otherwise indicated, all parts and percentages are by weight.

EXAMPLE 1

A degreasing composition was made by adding to water (84.16% by weight) the following and stirring until a homogeneous product was obtained:

| % by weight | |
|---|---|
| 4.18 | butyl Cellosolve |
| 4.18 | cocamido diethanolamine |
| 0.84 | sodium metasilicate pentahydrate |
| 0.50 | KOH (45% aqueous solution) |
| 1.96 | cocamidopropylbetaine |
| 4.18 | dodecylbenzenesulfonic acid, isopropylamine salt |

-continued

| % by weight | |
|---|---|
| | salt |

The product was used to clean engines in an automotive repair shop.

EXAMPLE 2

The following compositions are made as in Example 1:

| % by weight | |
|---|---|
| (a) | |
| 4.0 | 2-propoxyethanol |
| 4.5 | cocamido diethanolamine |
| 1.0 | sodium metasilicate pentahydrate |
| 0.25 | KOH (solid) |
| 2.0 | myristylamidopropyl betaine |
| 4.25 | nonylbenzenesulfonic acid, isopropylamine salt |
| balance | water |
| (b) | |
| 4.25 | butyl Cellosolve |
| 4.25 | myristamido diisopropanolamine |
| 0.75 | sodium silicate pentahydrate |
| 1.5 | KOH (20% aqueous solution) |
| 1.75 | cocamidopropyl betaine |
| 4.0 | dodecylbenzenesulfonic acid, ethylamine salt |
| balance | water |
| (c) | |
| 4.0 | ethyl Cellosolve |
| 4.5 | cocamido diisopropanolamine |
| 0.9 | sodium metasilicate pentahydrate |
| 0.5 | KOH (40% aqueous solution) |
| 1.9 | cocamidopropyl betaine |
| 4.2 | pentadecylbenzenesulfonic acid, isopropylamine salt |
| balance | water |
| (d) | |
| 4.1 | butyl Cellosolve |
| 4.4 | cocamido diethanolamine |
| 0.75 | sodium metasilicate pentahydrate |
| 1.9 | cocamidopropyl betaine |
| 0.5 | KOH (40% aqueous solution) |
| 4.25 | dodecylbenzenesulfonic acid, isobutylamine salt |
| balance | water |

The foregoing compositions are used to clean automotive engines, engine compartments and machinery soiled with oil, diesel fuel and the like.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A degreasing composition consisting essentially of 4.0–4.25% by weight of n-butoxyethanol, 4.0–4.25% by weight of a coconut diethanolamide, 0.75–1.0% by weight of sodium metasilicate pentahydrate, 0.2–0.3% by weight of potassium hydroxide, 1.75–2.0% by weight of cocamidopropyl betaine, 4.0–4.25% by weight of an isopropylamine salt of dodecylbenzenesulfonic acid and water.

* * * * *